United States Patent [19]

Halff et al.

[11] Patent Number: 4,470,593

[45] Date of Patent: Sep. 11, 1984

[54] GRIPPER ARRANGEMENT FOR SHEET-MACHINING INSTALLATIONS

[76] Inventors: Albert Halff, An der Maar 5, 4053 Juchen 6; Friedrich Schroter, Hauptstr. 30, 3001 Isernhagen FB, both of Fed. Rep. of Germany

[21] Appl. No.: 323,325

[22] Filed: Nov. 20, 1981

[30] Foreign Application Priority Data

Nov. 24, 1980 [DE] Fed. Rep. of Germany ..... 3044084

[51] Int. Cl.[3] ..... B65H 5/02

[52] U.S. Cl. ..... 271/277; 271/204

[58] Field of Search ..... 271/204, 206, 268, 277; 101/408

[56] References Cited

U.S. PATENT DOCUMENTS 3,183,827 5/1965 Kury ..... 271/206 X
3,809,390 5/1974 Lenoir ..... 271/204

FOREIGN PATENT DOCUMENTS 1153772 9/1963 Fed. Rep. of Germany .
1800267 8/1969 Fed. Rep. of Germany .
2520231 11/1976 Fed. Rep. of Germany ..... 271/277

*Primary Examiner*—Richard A. Schacher

*Attorney, Agent, or Firm*—Sprung Horn Kramer & Woods

[57] ABSTRACT

In a gripping equipment for sheet-processing machines wherein sheets are engaged by grippers moved along by driven chains and are forwarded intermittently from one station to the next, wherein the grippers are carried by a gripper shaft and are supported at their ends for swivelling movement about an axis parallel to the longitudinal axis of the gripping equipment, the improvement wherein the gripping equipment comprises a carriage having fixedly-supported rollers at the one end and resiliently-supported rollers at the other end for rolling on guideways at the stations to effect guidance transverse to the course direction of the carriage. Each of the leading ends of the gripper carriage is supported on one chain link for rotation about an axis parallel to the gripper shaft and counter to spring resilience. The carriage is guided by a roller and a roller guideway independent of the chain track. A stop surface near each of the ends of the gripper carriage is engageable with a stop at each station which is pivotable into the path of travel of the gripper carriage for effecting alignment of the gripper carriage in the direction of travel.

7 Claims, 9 Drawing Figures

GRIPPER ARRANGEMENT FOR SHEET-MACHINING INSTALLATIONS

The invention relates to a gripper arrangement for sheet-machining installations in which sheets engaged by grippers of the gripper arrangement conveyed along by driven chains are transported intermittently from station to station, with a gripper shaft carrying the grippers which at their extremities are rotatably mounted in supports formed by the gripper arrangement so as to be pivotable about an axis parallel to the longitudinal axis of the gripper arrangement, whilst said gripper arrangement at its other side in longitudinal direction is carried by positive connection in supports which are connected to the chains in non-positive manner against spring pressure.

A gripper arrangement of this kind is already known from German Patent Specification No. 25 20 231.

Gripper arrangement of this kind, hereinafter also referred to as gripper rods, are intended to convey sheets of paper, cardboard or the like from an input station by way of machining stations for stamping, knocking out, etc., to an unloading station. At the various stations, the gripper rods carried along by the driven endless chains are halted and, during the static period at the various stations, are positioned in alignment with positively controlled register devices and secured in that position. It is this problem of register to which the present invention relates and comprises register not only in the direction of motion but also in horizontal and vertical direction at right angles to the direction of motion of the gripper arrangement, i.e. in all three spatial directions.

Another gripper rod (DT-OS No. 18 00 267) possesses at its extremities conical apertures into which spring-loaded cones are inserted, thus connecting the extremities of the gripper rod to the chains. Moreover, the extremities of the gripper rod are carried in recesses connected to the chains so as to be displaceable in the direction of conveyance, which recesses also receive the cones and form a support for the spring. The cones project outwards through apertures in the recesses. When the gripper rod reaches a work station, a frame located beneath the gripper rod, i.e. the chain, and which also carries the tools for machining the sheet, is raised and in so doing carries with it the chains, the recesses and the gripper rods until the top sides of the cones strike against pistons mounted on the machine body and, as the frame continues to move upwards, are pressed into the recesses. At this point the positive connection is released between the cones and the extremities of the gripper rod which is aligned in the direction of coneyance by a register provided with a triangular groove which comes into contact with a triangular rib extending in longitudinal direction upon said gripper rod. Alignment of the gripper rod in its longitudinal direction does not take place since the gripper rod is guided at its extremities on rails.

Apart from its complicated construction, this last-named mechanism for registering or aligning the gripper rod also has the disadvantage that the frame with the machining tools requires to be raised, whereby not only the gripper rod but also the chains carrying the gripper rods are raised so that these are subjected to additional stress and, due to the wear occasioned by this stress, are unable to ensure a reliable guidance of the gripper rod. Furthermore, with this mechanism, the gripper rod within the work station is fixed in respect of its vertical position so that the important degree of freedom required in sheet-machining installations is lacking.

Even less advantageous are the features of another known gripper rod (DT-AS No. 11 53 772) in which the gripper rods are securely connected to the chains and, at the various work stations, are pressed into fork-like stop members with pins connected to the extremities. Here, the stress on the chains and also on the stops is so great that the resulting wear leads to tolerances which are no longer admissible in registering of the gripper rod.

In the case of the already mentioned gripper arrangement known from German Patent Specification No. 25 20 231, the gripper rod can be moved in all directions whereby exact alignment can be achieved without the chains being stressed or chain tolerances exerting any influence on the alignment of the gripper rod. This is made possible in an arrangement whereby simultaneously the positive connection between gripper rod and drive chain and the alignment of the gripper rod are effected in one work operation by a register coming into contact with the gripper rod. The register pivots the gripper rod about an axis parallel to its longitudinal axis, thus releasing the positive connection so that the gripper rod is released from the chain whilst at the same time the operation of aligning the gripper rod is initiated and is completed on reaching the end position of the register. The extremities of the gripper rod can be adjusted in the recesses in all directions so that the gripper rod is accurately aligned.

The construction described above has proved very successful in cases where the operating speeds required are not too high. More recently however, stamping and knock-out installations have been produced which permit of much higher operating speeds than in the case of the older machines. The known type of gripper rod cannot cope with these higher operating speeds because the accelerations occasioned thereby during the alignment process produce an enormously high noise level and also in particular very high levels of material stress, with rapid wear.

The object of the invention is to provide a gripper arrangement which permits of even higher speeds of operation whilst retaining the former advantageous manner of operation.

The problem is solved by the gripper arrangement having the form of a carriage which has at one extremity rollers with fixed mounting and at the other extremity rollers with resilient mounting, which at the work stations are in rolling contact with guide rails guiding them at right angles to the direction of motion of the carriage; the extremities of the gripper carriage are in each case suspended from one chain link of the chain which is guided by a chain track so that they are rotatable against spring pressure about an axis parallel to the gripper shaft, and are guided by a roller in a guide track independent of the chain track. The gripper carriage has in the region of its extremities in each case a stop surface for a stop which is pivoted at each station into the path of travel of the gripper carriage and which effects alignment of the gripper carriage in the direction of travel.

By means of this construction it is possible to maintain constant guidance of the gripper carriage in the two directions at right angles to the direction of travel as it passes through the work station, so that a further alignment in these two directions requiring abrupt movements is not necessary at the actual work point, and in the direction of travel is effected by a stop device. The stop device is easily controllable so that, although involving bumping of the gripper rod during alignment, this remains the only relatively abrupt direction-change operation. This is due to the fact that, by the construction according to the invention, when the machine is once more set in motion, it is possible without any difficulty to synchronise the movements of stop and chain so that here there is practically no loading of the chain and stop whereby firstly, the desired low noise and freedom from wear are ensured even at much higher operating speeds than have hitherto been possible, and secondly, accuracy of register or alignment is obtained.

According to an advantageous method of execution of the invention, the stop is provided with a pivot drive synchronised with the chain motion whereby, at the beginning of the chain motion, the stop and the stop face follow the same motion in the direction of conveyance whilst at the same time the stop performs a movement leading out of the direction of conveyance and a movement accelerating more and more relative to the movement of the gripper carriage until the stop has left the path of travel.

This construction offers the particular advantage that it ensures an extraordinarily quiet, stress-free starting phase after the static period of the gripper rods.

A desirable feature is that separate guide tracks are provided for chain and gripper carriage whereby certain controls of the gripper carriage by way of cam-operated pressure rollers can be employed.

An embodiment of the invention will now be described in more detail with reference to the drawings in which.

Figure 1:
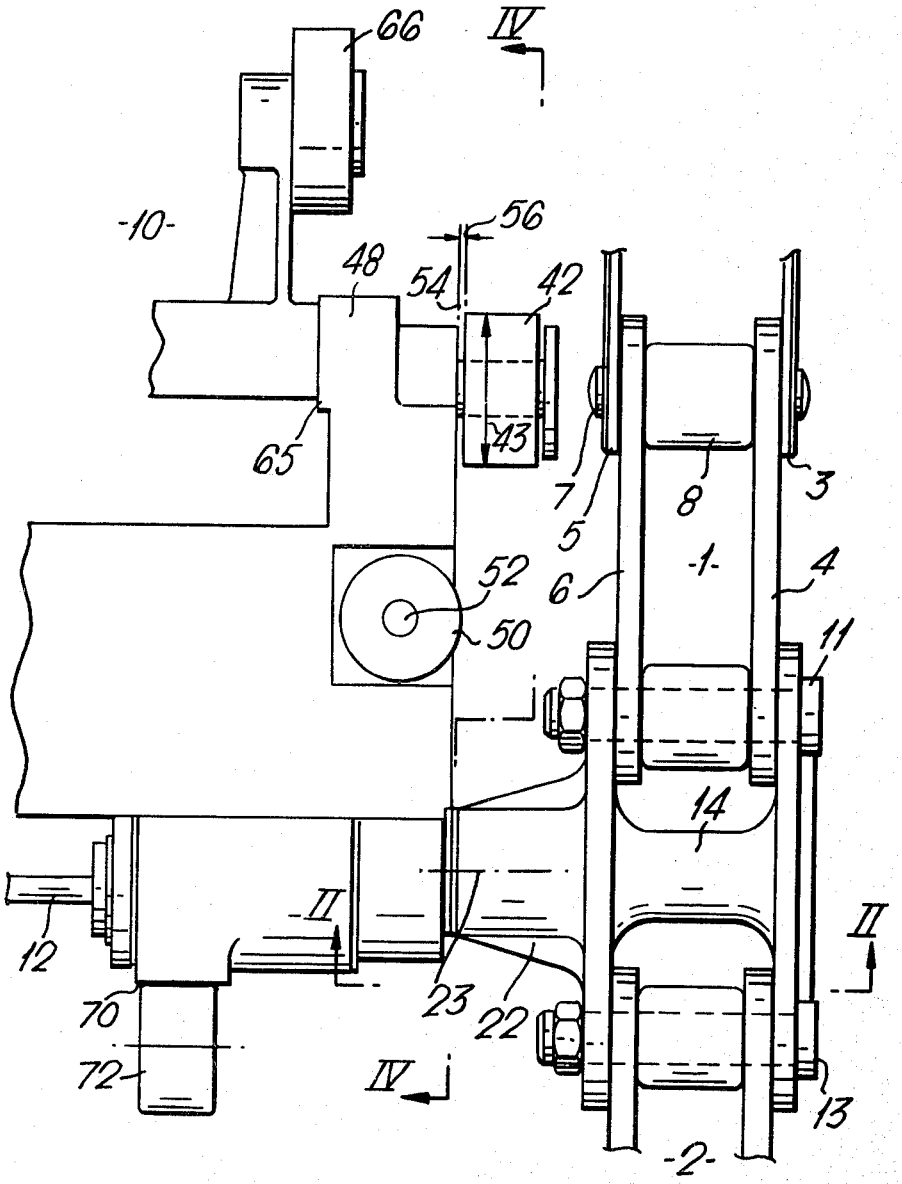
FIG. 1 is a plan view of one extremity of a carriage-type gripper arrangement according to the invention, showing also the chain link connected thereto.

In a part-view from above FIG. 1 shows one extremity of the gripper arrangement according to the invention in the form of a gripper carriage 10. The other extremity of this gripper carriage 10 is shown in a similar view in FIG. 3. The gripper carriage 10 is non-positively connected against spring pressure to a member 14 of a chain 16 by way of a torsion bar spring 12, the member 14 having a special construction of chain-lock type which differs from the following chain links, as will be explained hereinafter.

Figure 2:
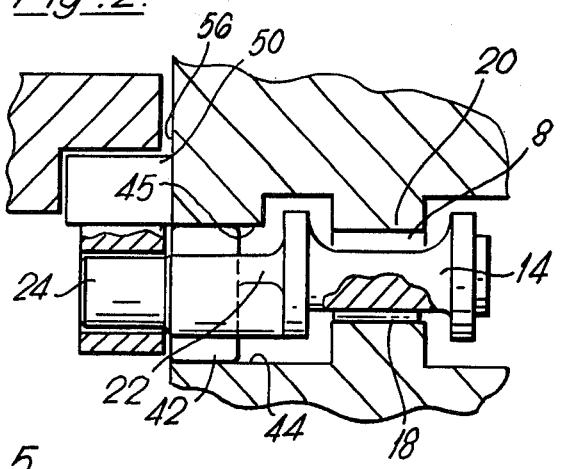
FIG. 2 is a side elevation of the extremity of the gripper arrangement, following the arrows II—II, FIG. 1.

As is shown in FIG. 2, which is a side elevation of the gripper carriage extremity of FIG. 1 in the direction of the arrows II—II (this is contrary to the direction of travel of the gripper carriage), at the place of the sheet-machining apparatus illustrated here, representing for example a stamping area, the chain 16 is conveyed through runners 18, 20 which are part of the machine frame otherwise not illustrated.

Of the roller chains fitted at each extremity of the gripper carriage 10 and driven in a continuous circle without the machine frame, only one can be seen in detail in FIG. 1. This is a sprocket chain comprising links 1 and 2, the side bars 3, 4 or 5, 6 of which are interconnected by bolts 7. Between the inner side bars 4, 6 in each case of each chain link, spacer rollers 8 are provided. The two chain links 1, 2 are interconnected by a special member 14 in the form of a chain lock, employing bolts 11, 13. The chain lock 14 has on its side facing towards the interior of the machine a bracket 22 continued in the form of a journal 24 (see also FIG. 2).

Figure 4:
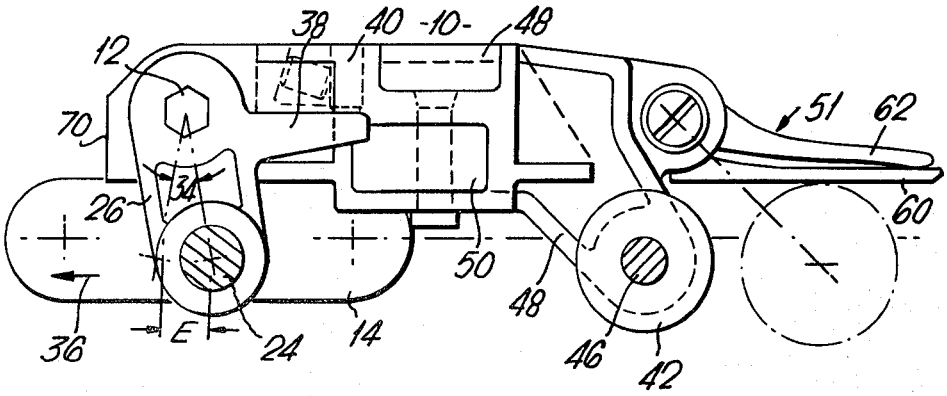
FIG. 4 is a side elevation view of the gripper device at a right angle to the direction of travel of the gripper carriage, following the arrows IV—IV of FIG. 1.

On the journal 24 one extremity of a short lever arm 26 is rotatably mounted, as shown for example in FIG. 4 which is a side elevation view partly in section of the extremity of the gripper carriage 10 illustrated in FIG. 1, following the arrows IV—IV. The other extremity of the lever 26 is non-rotatably connected to the aforementioned torsion bar spring 12 which in turn is secured at this end connected to the lever 26 in a bearing bush 28, which in turn is rotatably mounted in a rotary bearing 30 which is part of the gripper carriage. The other extremity of the torsion bar spring 12 is non-rotatably secured in a suitable bracket 32 carried on the gripper carriage (see FIG. 3). By this arrangement the lever 26 can be pivoted against the force of the spring 12 through a determined rotary angle 34, as indicated in FIG. 4. Thereby, on the other hand, the gripper carriage 10 can be displaced relative to the chain lock 14 (distance E in FIG. 4) and consequently to the chain 16 in the direction of travel of the gripper carriage 10 (see arrow 36). The rotary movement is limited by a lug 38 which, due to the action of the spring 12, contacts a stop 40. Instead of a torsion bar spring connection between the gripper carriage 48 and the chain lock 14, other spring arrangements are of course possible, as for example a tension or compression spring acting upon a lug similar to the lug 38.

The stop 40 may be adjustable, for example in the form of an adjustor screw whereby it is possible to align the gripper carriage relative to the chains 16 for transport operation, for example in order to ensure that the lateral edges of the sheet in transport are parallel to the direction of travel, or that the various gripper carriages of the sheet-machining apparatus (e.g. as many as eight gripper carriages may be carried by the rotating chains) maintain an equal distance apart, which is necessary for accurate time control of the operational cycle.

Figure 8:
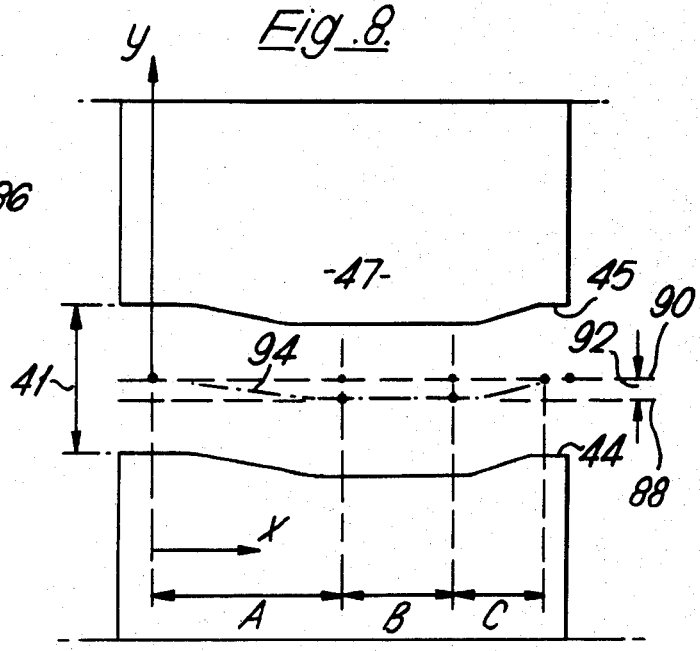
FIG. 8 is a side elevation view of part of one guide track for the gripper carriage.

It will have become clear that the forward extremity of the gripper carriage 10 shown at the left hand of FIG. 4, is conveyed by the chain lock 14 in a vertical direction, at a right angle to the direction of travel of the carriage, said lock 14 receiving its guidance in turn by the runners 18, 20 of FIG. 2. Since the gripper carriage is rotatable in axial direction around the shaft 24, it requires a second guidance at its rear extremity shown at the right of FIG. 4, for which purpose a roller 42 is employed which comes into rolling contact with a rail, also present at every work station, comprising a lower guide track 44 and an upper guide track 45. Refer also to FIG. 8 which gives a side elevation view of these guide tracks at a work station. The space 41 between these two guide tracks 44, 45 is only slightly larger (e.g. 0.1 mm–0.2 mm) than the diameter of the roller 42 guided by them. The roller 42 is rotatably carried on a further journal 46 which in turn is carried on the chassis 48 of the gripper carriage 10.

Guidance of the gripper carriage vertical to the plane of travel within the plane of travel is effected at the side of the carriage shown in FIG. 1 by means of a roller 50 which is rotatably mounted on a journal 52 rigidly secured to the chassis 48 of the gripper carriage 10 at a right angle to the plane of travel. The roller 50 projects by a distance 56 beyond the lateral frontage 54 of the chassis 48 and is in rolling contact with a track 56 of the machining station disposed at a right angle to the track 20. On the other side of the gripper carriage 10 (see FIG. 3) is located a similar roller 58 providing lateral guidance, which in fact is movable in direction of the arrows 61 against spring pressure vertically in relation to the rolling surface 63.

Thus, the gripper carriage is carefully aligned in all directions disposed at right angles to the direction of travel thereof.

Figure 5:
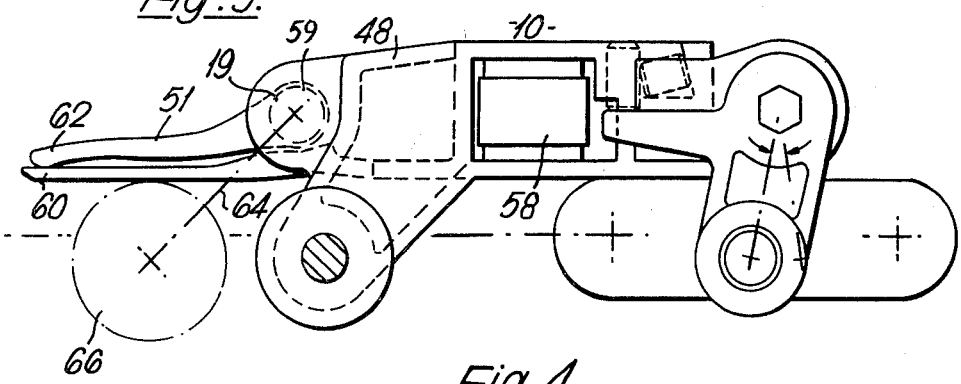
FIG. 5 is a similar view to FIG. 4, following the arrows V—V, FIG. 3.
Figure 3:
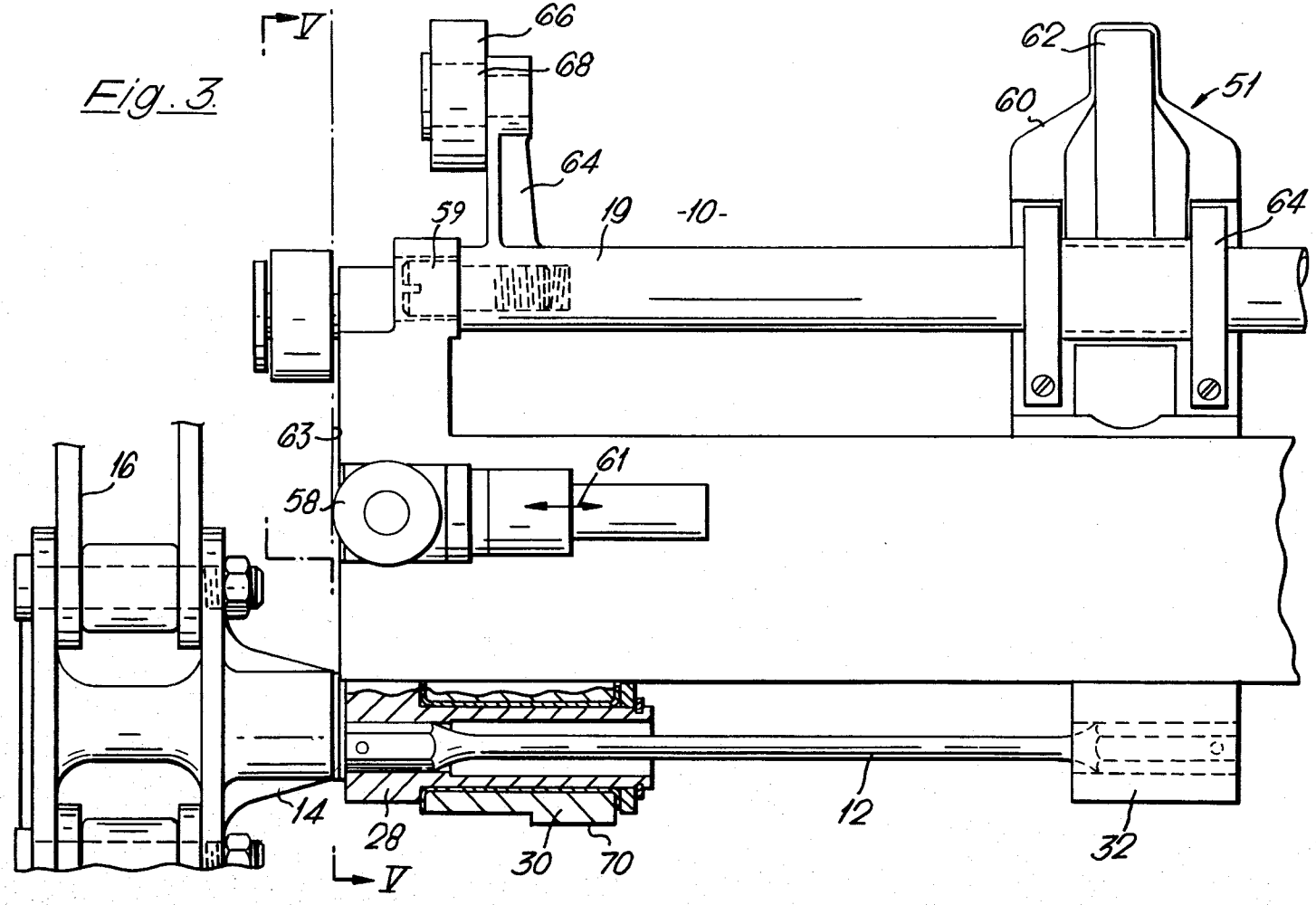
FIG. 3 is a similar view to that of FIG. 1, showing the other extremity of the gripper carriage, including the spring devices connecting the gripper carriage to the chain and one of the grippers.

In order to ensure sufficient stability of the gripper carriage and on the other hand to maintain at a minimum its weight, and consequently also the acceleration forces acting thereon, the gripper carriage is characterised by a box-like construction with relatively thin walls, as indicated for example in FIGS. 4 and 5. At its rear extremity in the direction of travel (to the left in FIG. 5 and right in FIG. 4, i.e. top in FIG. 3) the box-like chassis 48 has a hollow profile rod 19 pivotably mounted in rotary bearings 59 or 65, said profile rod 19 having several grippers 51, one of which is illustrated in FIG. 3. The grippers comprise in each case a lower clamping jaw 60, for example rigidly connected to the chassis 48, and an upper clamping jaw 62 which can be secured in a desired position against rotation on the aforementioned profile rod 19 by means of suitable clamping devices 64. Thus, if the hollow profile shaft 19 (see FIG. 5) is rotated in clockwise direction, the gripper 51 opens, the upper clamping jaw 62 connected to the shaft 19 being raised from the lower jaw 60. Pivoting of the shaft 19 is effected for example by way of a lever 64 (shown only diagrammatically), at the free extremity of which a track wheel 66 is carried so as to be rotatable about a shaft 68 parallel to the shaft 19. The track wheel 66 follows a cam track constructed in such a manner that at the desired point of time the wheel 66 rises and the gripper 51 is opened to receive the edge of a sheet of paper to be transported, whereupon it moves along a lower cam track portion and closes again thus securing the sheet.

As shown in FIG. 8, the rail 47 for the roller 42 is also curved, that is to say, exactly at the point at each work station at which the gripper carriage 10 is required to lower the sheet held by the grippers 51 to working level represented for example by the stamping counter-plate or the knock-out frame (not illustrated) and lying a few millimeters lower than the transport level, which is intended to ensure smooth conveyance of the sheet over the knock-out frame, for example. The rail 47 guides the roller 43, and consequently also the grippers 51, along a cam track 94, shown dotted in FIG. 8. (The path of the grippers 51 differs in fact from that of the roller 42 by a proportionality factor since the distance between the grippers 51 and the pivot point 23 is greater than that of the roller 43). It will be seen that, with motion in the direction X in the area A, the track 94 drops continuously from the transport level 90 to the working level 88, remains in the area B at the working level (during this time the machining of the sheet takes place), and then rises in the area C again to the transport level. Since the difference in level 92 amounts here only to a few millimeters, the acceleration forces acting on the sheet at a right angle to the plane of the sheet (Y direction) remain small, especially as the descent in the area A occurs at the very time when the speed of the carriage is approaching zero, which is in fact actually reached then in the area B. Fluttering within the sheet is therefore eliminated.

The most important aspect of the present invention will now be explained. Reference is now made to FIG. 7 which again shows diagrammatically the chassis 48 of the gripper carriage in cross section. On its left hand side (front in direction of travel) the chassis 48 is provided with a stop face 70 which serves to align the carriage accurately in the direction of travel at the various stations during the work operation to be carried out at that station (e.g. stamping or knocking out). This alignment is effected by the arrangement of a stop wheel 72 (see FIGS. 1 and 7) which comes into contact with the stop faces 70 located at the left and right hand extremities of the carriage, said wheel being rotatably carried on a pin 74 which in turn is carried by a lever 76 welded on to a hollow shaft 76. The hollow shaft 78 (see also FIG. 6) is rotatably mounted on its axis within the station and can be pivoted by a rod system so that the lever 78 can be moved with the stop wheel 72 between a stop position (see direction 80) shown in FIG. 7 and a second position swung out of the path of travel of the gripper rod 10 (see reference numeral 82).

The rod system for actuating the hollow shaft 76 may comprise a further lever 84 welded to the hollow shaft 76, which (lever) can be actuated by a drive lever system 86 (not illustrated in further detail).

Figure 6:
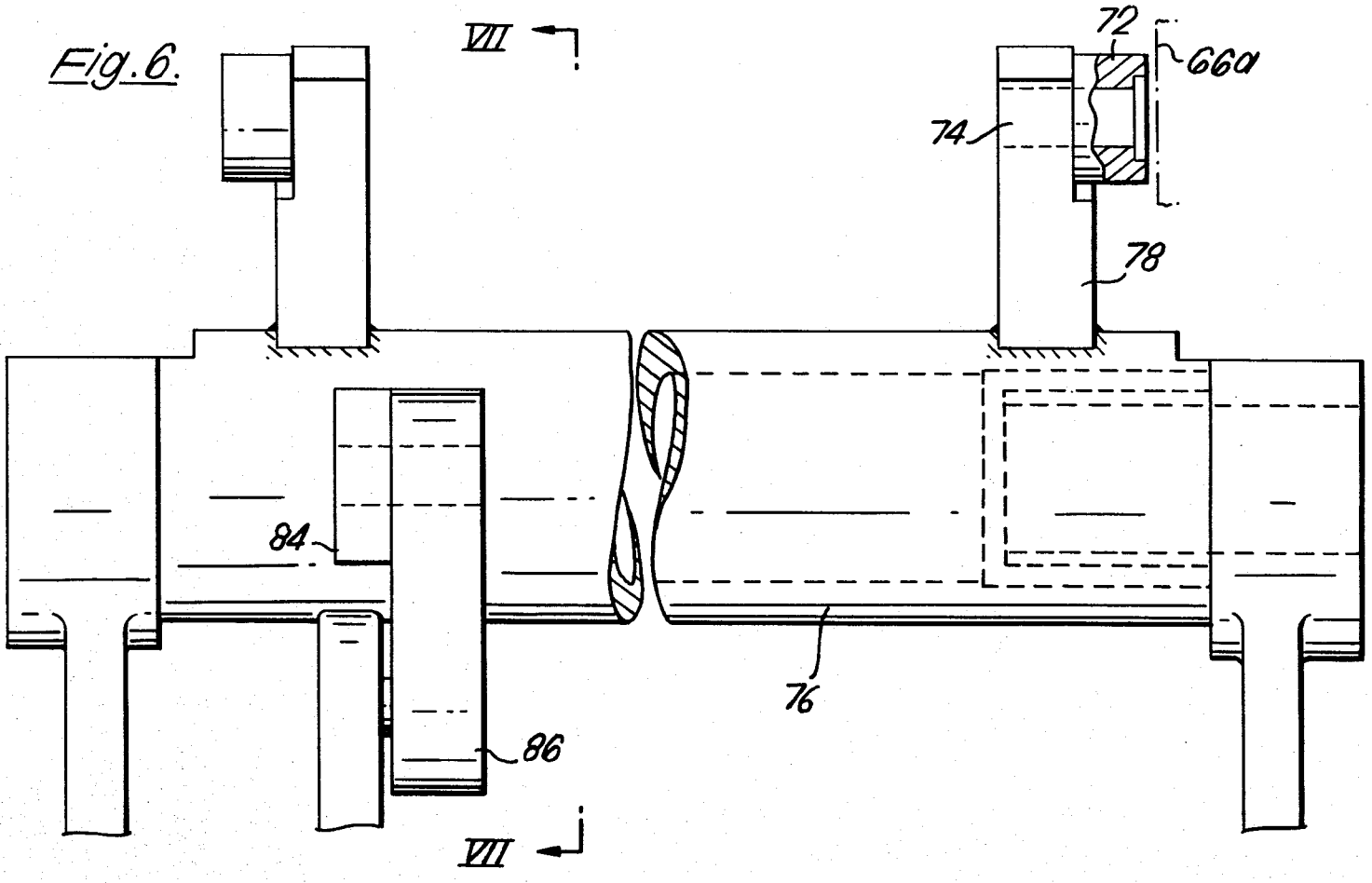
FIG. 6 is a side elevation view of the stop device of a station, seen in the direction of travel of the gripper carriage.
Figure 7:
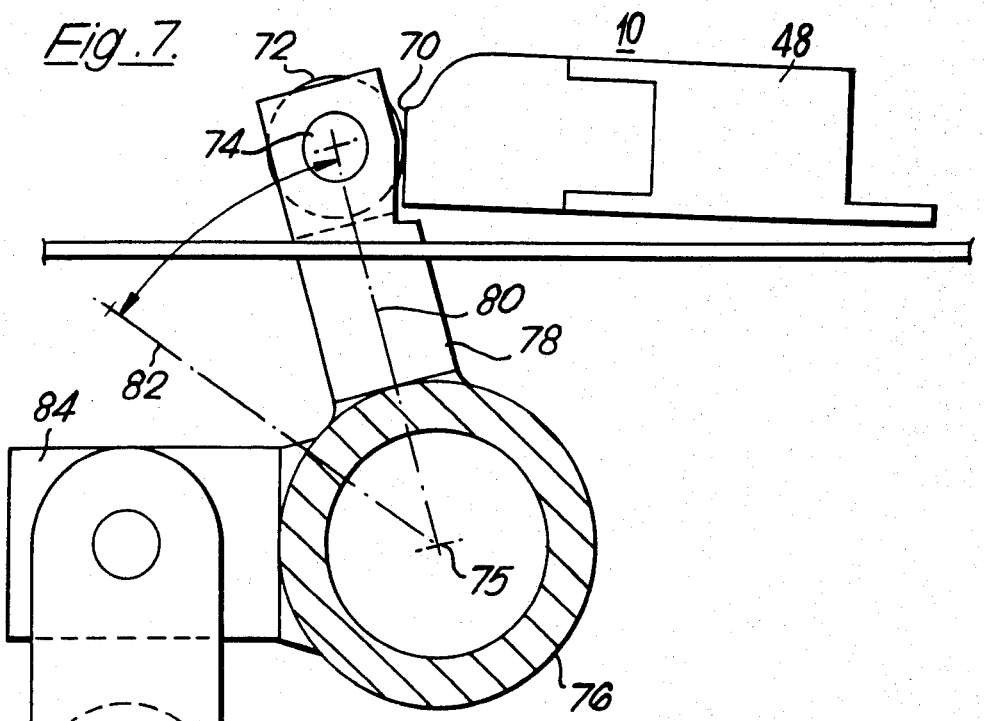
FIG. 7 is a side elevation view, partly in section, of the stop device following the arrows VII—VII of FIG. 6.

The stop roller 72 is preferably so arranged that it lies as far out as possible at the particular extremity of the gripper carriage in order to improve the accuracy of adjustment, but at the same time leaving sufficient room for the other rollers described above, e.g. for the opener roller 66 for the grippers 51, which is indicated in FIG. 6 by the reference numeral **66*a*** relating to its alignment.

The lever system for the stop rollers 72 can be co-ordinated with the particular machining tool for the sheet at this station, and also with the chain drive, in such a manner that a type of operation is obtained which will now be described in more detail with reference to FIG. 9.

The chain drive and pivot drive 78, 76, 84 can be so co-ordinated that the path (curve 172 of FIG. 9) of the stop 72 on conclusion of the work operation to be undertaken on the sheet at the station (e.g. stamping, knocking out, and unloading of the sheet), and also the path (W) of the stop surface (curve 170) proceed approximately according to a function of second order ($w=a(t+\psi)+b(t+\psi)^2+c$, with w=path, t=time of cycle and a, b, c, $\psi$ as constants) or approximately according to an angle function ($w=\cos(\omega\cdot t+\psi)$, with $\omega$ and $\psi$ as constants). The constants can be so selected (e.g. $c=w_1$ and $\psi=D$ for curve 170 and $C=0$ and $\psi=0$ for curve 172), that, in a first time span, a pre-tension ($W_1$) occurring as the carriage strikes against the stop device against spring pressure reaches an end whereupon the stop roller 72 is raised from the stop surface 70.

Further, the constants can be so selected that the difference in speed occurring at the moment of raising between the speeds of the stop roller 72 and the stop surface 70 does not exceed a predetermined value even with increasing values for the pre-tensioning path ($W_1$, $W_4$, $W_2$, $W_3$).

Figure 9:
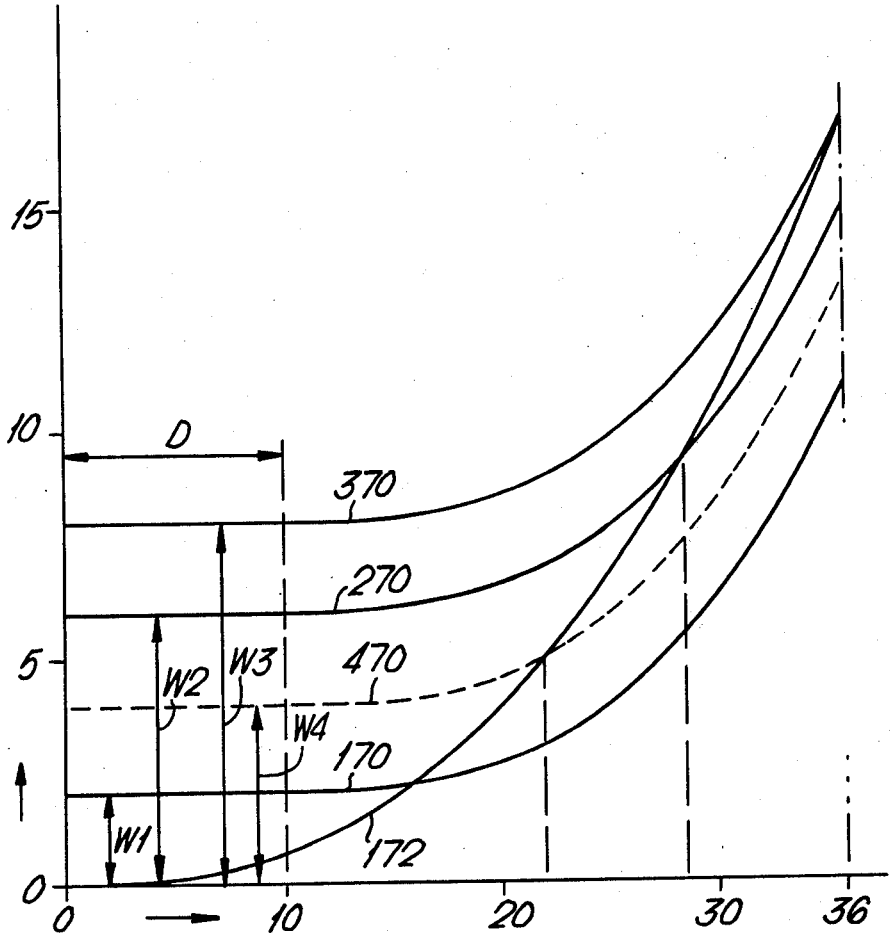
FIG. 9 is a diagrammatic sketch showing the manner of working of the stop device illustrated in FIGS. 6 and 7.

FIG. 9 shows by means of a diagrammatic sketch the path in the direction of travel which the stop roller 72 (curve 172), or stop face 70 of the gripper carriage 10 (curves 170, 270, 370, 470) follows in relation to the duration of the cycle. The duration of the working cycle is indicated in degrees (angle), whereby a full cycle is indicated by 360°, that is to say the time which is involved between for example the stamping of a sheet and the stamping of the following sheet. With a work output of for example 7200 sheets per hour, the full time cycle thus amounts to exactly 0.5 sec, so that the time illustrated in FIG. 9 extending from 0° to 360° would amount to 0.05 sec. The distances covered during this very short time span certainly amount to only a small number of millimeters (the units of the ordinate could indicate millimeters), but nevertheless, because of these short times, the speeds and differences in speed (accelerations) thus involved are considerable.

Referring to FIG. 4, the gripper carriage 10 moves in direction of the arrow 36 towards the left and pulls behind it the sheet (not illustrated) which is held in the jaws of the gripper 51. In so doing, the gripper carriage is guided laterally in the manner already described, by rollers 50, 58, and vertically by the chain locks 14 and the rollers 42. A coarse adjustment of the gripper carriage to obtain an exact position vertical to the path of travel is effected by the stops 40 (possibly adjustable) for the lever arm 26 which is pivotable against spring pressure (torsion bar spring 12) and which enables the gripper carriage to be displaced relative to the chain lock 14.

On approaching the work station, the chain drive decelerates the movement of the chain and thus, via the chain lock 14, the movement of the gripper carriage 10, until almost dead stop is reached. At this moment the stop faces 70 of the gripper carriage 10 touch the stop rollers 72 of the stop device of FIG. 7 which have been pivoted upwards in the direction 80, and thus determine very accurately the position of the gripper carriage 10 in the direction of travel. Any possible, slight further movement of the chains is here taken up without difficulty by the resilience of the gripper carriage in respect of the chain lock 14 as a result of the yielding connection by way of the torsion bar spring 12, so that it is not possible, for loading of the chain by the positioning operation to occur, with the ensuing strident operating noises and consequent frictional wear. During the period when the gripper carrier 10 remains static in the position accurately determined by the stop 72, the work operation proceeds (stamping, knocking out, etc.), wherein, as a result of the accurate positioning provided by the invention, even very compact tools can be successfully employed.

On completion of the work operation (time cycle as fixed by FIG. 9 is 0°), the chain is once more set in motion, preferably with a time interval D of, for example, 10°. At the point of time 0° the hollow shaft 76 (see FIG. 7) also begins to rotate in anti-clockwise direction under control of the lever drive 84, preferably at a speed such that the speed of the stop face of the pressure roller 72 projected on to the path of travel of the gripper carriage 10 takes the movement time indicated in FIG. 9 at 172, which has for example a cosine form. The curve 172 begins at the origin, but the curve 170 begins at a certain distance value $W_1$, which is a certain portion of the distance E shown in FIG. 4.

Indeed, in order to ensure reliable contact of the carriage 10 with the pivotable stops 72, the adjustment of the gripper carriage 10 relative to the chain (e.g. by means of stop screw 40, FIG. 4) by permitting the chain to continue moving, after arrest of the gripper carriage, along the path $W_1$ whilst the carriage remains at the stop. At the same time, the lug 38 is raised from the stop 40 against the force of the torsion bar spring 12 (FIG. 3).

As a result of the timelag D, and also of the rather more pronounced rate of increase in speed, the curve 172 intersects the curve 170, whereupon the point of time (time of cycle 16°) is reached when the pre-tension path $W_1$ is at an end and the stop roller 72 begins to rise from the stop face 70. At this point of time, for example with an output speed of 7200 sheets per hour, the speed difference between roller 72 and face 70 (equal to the difference in inclination of the curves 172 and 170) amounts to 0.25 m/sec. Until it is raised, the roller 72, by pivoting round of the lever 78, moves down along the stop face 70 and finally leaves the path of travel of the gripper carriage (after rising) to reach the position indicated by the direction 82 in FIG. 7.

In this position the lever 78 remains until the gripper carriage 10 and the sheet it is dragging behind it have again left the work station. Now the lever 78 can be once more pivoted into the path of travel (direction 80) of the gripper carriage 10 in order to register accurately the next gripper carrier on its arrival, in the manner already described.

It has been found that, as compared with the hitherto known arrangements already referred to, this type of gripper carriage register arrangement offers considerably less chain-loading and chain wear, whilst at the same time, the working speed can be considerably increased. A further advantage is to be found in the fact that, since the acceleration forces acting upon the gripper carriage are smaller, the vibrations arising in the gripper carriage and also in the sheet are less marked, which also enables greater accuracy to be achieved in stamping or knocking out or like operations.

Another advantage of the stop device described above is that, after the machine has been operating for some time, any increase in the length of chains due to wear do not adversely affect operation. If for example, due to wear, the chain between two gripper carriages (=one system length) is lengthened by 2 mm, ever-increasing path displacements W occur at the successive work stations of the sheet-machining apparatus (comprising for example a stamping station, knock-out station and delivery station). For example, with reference to FIG. 9, a path displacement $W_2$ of 6 mm occurs at the knock-out station (curve 270) and at the delivery station (curve 370) a path displacement $W_3$ of even 8 mm, whilst at the stamping station (curve 470) the path displacement would amount to only approximately 4 mm. As will be observed from the points of intersection of the curve 172 and the curves 470, 270 and 370, in spite of the considerable chain-stretching leading at the last station to a path displacement of 8 mm, the stop roller 72 at this station is raised still within 36° time of cycle, whereby in all cases the speed difference at the moment of raising remains at a value less than, for example, 0.2 m/sec . . . 0.25 m/sec (at a working speed of 7200 sheets per hour). Only when the chain has lengthened to an even greater extent is it necessary to make adjustment by means of the screw 40 (FIG. 4), because otherwise the roller 72 reaches the lower edge of the stop face 70 before the roller 72 rises from the face 70.

We claim:

1. In a gripping equipment for sheet-processing machines wherein sheets are engaged by grippers moved along by driven chains and are forwarded intermittently from one station to the next, wherein the grippers are carried by a gripper shaft and are supported at their ends for swivelling movement about an axis parallel to the longitudinal axis of the gripping equipment, the improvement wherein the gripping equipment comprises a carriage having fixedly-supported rollers at one end and resiliently-supported rollers at the other end for rolling on guideways at the stations to effect guidance transverse to the course direction of the carriage; means supporting each of the leading ends of the gripper carriage on one chain link for rotation about an axis parallel to the gripper shaft and counter to spring resilience; means guiding the carriage comprising a roller and a roller guideway independent of the chain track; and means including a stop surrace near each of the ends of the gripper carriage and a stop engagable with the stop surface and pivotable at each station into the path of travel of the gripper carriage for effecting alignment of the gripper carriage in the direction of travel.

2. The gripping equipment according to claim 1, further comprising means for pivoting the stop synchronised with the chain movement.

3. The gripping equipment according to claim 1 or 2, wherein the stop comprises a stop roller pivotable about a shaft disposed below the path of travel and parallel to the axis of the gripper carriage, the stop roller being disposed in the aligning idle position such that the point of contact with the stop surface is situated vertically above the swivel axis of the shaft or slightly ahead of this point in the direction of travel of the gripper carriage.

4. The gripping equipment according to claim 2, further comprising means coordinating the chain drive and swivel motion such that the path followed by the stop after completion of an operation and the path followed by the stop surface approximate a function of second order ($w=a(t+\psi)+b(t+\psi)^2+c$, w being the path, t being time in the cycle and a,b,c,$\psi$ being constants.

5. The gripping equipment according to claim 2, further comprising means coordinating the chain drive and swivel motion such that the path followed by the stop after completion of an operation and the path followed by the stop surface approximate a trigonometric function ($w=\cos(\omega \cdot t+\psi)$, $\omega$ and $\psi$ being constants.

6. The gripping equipment according to claim 4 or 5, wherein the constants are so selected that, in a first time interval, an initial stress ($W_1$), resulting from the carriage running up the stop device contrary to spring tension, is dissipated and thereupon the stop roller is lifted from the stop surface.

7. The gripping equipment according to claim 4 or 5, wherein the constants are so selected that the difference in speed occurring at the moment of lifting between the speeds of the stop roller and the stop surface reaches at most a predetermined value even with increasing values for the initial stress displacement.

* * * * *